US009972467B2

(12) United States Patent
Asari et al.

(10) Patent No.: US 9,972,467 B2
(45) Date of Patent: May 15, 2018

(54) VACUUM VALVE AND MANUFACTURING METHOD FOR THE SAME

(71) Applicant: Kabushiki Kaisha Toshiba, Tokyo (JP)

(72) Inventors: Naoki Asari, Tokyo (JP); Junichi Sato, Tokyo (JP); Tetsu Shioiri, Saitama (JP); Yuki Sekimori, Saitama (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days. days.

(21) Appl. No.: 15/217,581

(22) Filed: Jul. 22, 2016

(65) Prior Publication Data

US 2016/0329181 A1 Nov. 10, 2016

Related U.S. Application Data

(63) Continuation of application No. PCT/JP2015/000041, filed on Jan. 7, 2015.

(30) Foreign Application Priority Data

Jan. 24, 2014 (JP) ..... 2014-011101

(51) Int. Cl.
*H01H 33/662* (2006.01)
*H01H 33/24* (2006.01)
*H01H 11/00* (2006.01)

(52) U.S. Cl.
CPC ..... *H01H 33/66207* (2013.01); *H01H 11/00* (2013.01); *H01H 33/24* (2013.01);
(Continued)

(58) Field of Classification Search
CPC .. H01H 33/66207; H01H 11/00; H01H 33/24; H01H 2033/6623; H01H 2033/66284
(Continued)

(56) References Cited

U.S. PATENT DOCUMENTS 5,808,258 A * 9/1998 Luzzi ..... H01H 33/66207 218/136
7,285,743 B2 * 10/2007 Martin ..... H01H 33/027 218/138
(Continued)

FOREIGN PATENT DOCUMENTS

CN 1272950 A 11/2000
EP 0087881 A1 9/1983
(Continued)

OTHER PUBLICATIONS

Extended Search Report issued in related EP Application No. 15740123.3, dated Jul. 21, 2017 (5 pages).
(Continued)

*Primary Examiner* — Renee S Luebke
*Assistant Examiner* — William Bolton
(74) *Attorney, Agent, or Firm* — Baker Botts L.L.P.

(57) ABSTRACT

A vacuum valve according to embodiments of the present disclosure comprise a prescribed shaped vacuum insulation vessel 1 having openings on its both ends, sealing metal fittings 2,3 configured to seal the openings of the vacuum insulation vessel 1 respectively, and a pair of contact points 5,6 which can be brought into contact or out of contact with each other and is arranged within the vacuum insulation vessel 1, wherein the vacuum insulation vessel 1 includes a base material layer 1*c* of aluminum oxide, a 1st oxidization promotion layer 1*a* whose oxygen combination was promoted, which 1st oxidization promotion layer 1*a* is formed on the inner circumference of the base material layer 1*c*, and a 2nd oxidization promotion layer 1*b* whose oxygen combination was promoted, which 2nd oxidization promotion layer 1*b* is formed on the outer circumference of the base material layer 1*c*.

6 Claims, 4 Drawing Sheets

(52) U.S. Cl.
CPC ..... *H01H 2033/6623* (2013.01); *H01H 2033/66284* (2013.01)

(58) Field of Classification Search
USPC ..... 218/139, 134, 155, 136; 174/50
See application file for complete search history.

(56) References Cited

U.S. PATENT DOCUMENTS

| | | | | |
|---|---|---|---|---|
| 8,110,771 | B2 * | 2/2012 | Takahashi | H01H 33/66207 218/136 |
| 2002/0043516 | A1 | 4/2002 | Morita et al. | |
| 2006/0152890 | A1 * | 7/2006 | Yokokura | H01H 33/24 361/605 |

FOREIGN PATENT DOCUMENTS

| | | | |
|---|---|---|---|
| EP | 119010 | A1 | 7/2001 |
| EP | 1124237 | A2 | 8/2001 |
| EP | 1501101 | A2 | 1/2005 |
| JP | 2008-282557 | A | 11/2008 |
| JP | 2009-193734 | A | 8/2009 |
| JP | 2010-015919 | A | 1/2010 |
| WO | 2000/021107 | A1 | 4/2000 |

OTHER PUBLICATIONS

International Search Report and Written Opinion issued in related PCT Application No. PCT/JP2015/000041 dated Feb. 24, 2015, 10 pages (with Translation of ISR).
International Preliminary Report on Patentability issued in related Application No. PCT/JP2015/000041, dated Aug. 4, 2016 (7 pages).

* cited by examiner

VACUUM VALVE AND MANUFACTURING METHOD FOR THE SAME

CROSS-REFERENCE TO RELATED APPLICATIONS

This application is a Continuation of PCT Application No. PCT/JP2015/000041, filed on Jan. 7, 2015, and claims priority to Japanese Patent Application No. 2014-011101, filed on Jan. 24, 2014, the entire contents of both of which are incorporated herein by reference.

TECHNICAL FIELD

Embodiments of the present disclosure relate to a vacuum valve which can improve the insulating properties of a surface of a vacuum insulation vessel, and a manufacturing method for the same.

BACKGROUND

Alumina ceramics which are excellent in insulating properties are used for a vacuum insulation vessel of a vacuum valve which has a pair of contact points which can be brought into contact or out of contact with each other On the other hand, the latest vacuum valves are in a tendency of high-voltage, and improvement measures for electric strength in a vacuum, using electric field relief of electrodes or area effect exerted on a breakdown electric field are implemented.

In such improvement measures for the electric strength, although properties between vacuum gaps improve, there is a limit in improvement of properties in surface insulation of the vacuum insulation vessel.

That is, a surface dielectric breakdown in the vacuum somewhat differs from a dielectric breakdown between the vacuum gaps as a phenomenon. Once a field electron emitted from the electrodes is charged on the surface and arrives at a critical field, it emits a secondary electron and will result in the dielectric breakdown.

Although the control of electrification can be carried out by adding other ingredients to the vacuum insulation vessel and decreasing its resistivity, there is a limit in controlling the electrification without changing fundamental ingredients.

When the electrification occurs, it is detected as partial discharge with luminescence.

For these reasons, it is desired to improve surface insulating properties without changing the ingredients of the alumina ceramics.

Here, regarding the vacuum valve whose outer circumference is molded by an epoxy resin, since its external insulation is reinforced, at least an improvement of properties in the surface insulating which is internal insulation in a vacuum is desired.

SUMMARY

It is an object of the present invention to provide a vacuum valve and manufacturing method for the same capable of controlling an electrification phenomenon which occurs before a dielectric breakdown in a surface of a vacuum insulation vessel, and improving surface insulating properties.

A vacuum valve according to embodiments of the present disclosure is proposed to accomplish the above object. A vacuum valve, comprising: a prescribed shaped vacuum insulation vessel having openings on its both ends, sealing metal fittings configured to seal the openings of the vacuum insulation vessel respectively, and a pair of contact points which can be brought into contact or out of contact with each other and is arranged within the vacuum insulation vessel, wherein the vacuum insulation vessel includes: a base material layer of aluminum oxide, a 1st oxidization promotion layer whose oxygen combination was promoted, which 1st oxidization promotion layer is formed on the inner circumference of the base material layer, and a 2nd oxidization promotion layer whose oxygen combination was promoted, which 2nd oxidization promotion layer is formed on the outer circumference of the base material layer.

DETAILED DESCRIPTION

Hereafter, embodiments of the present disclosure will be described with reference to the accompanying drawings.

First Embodiment

Figure 1:
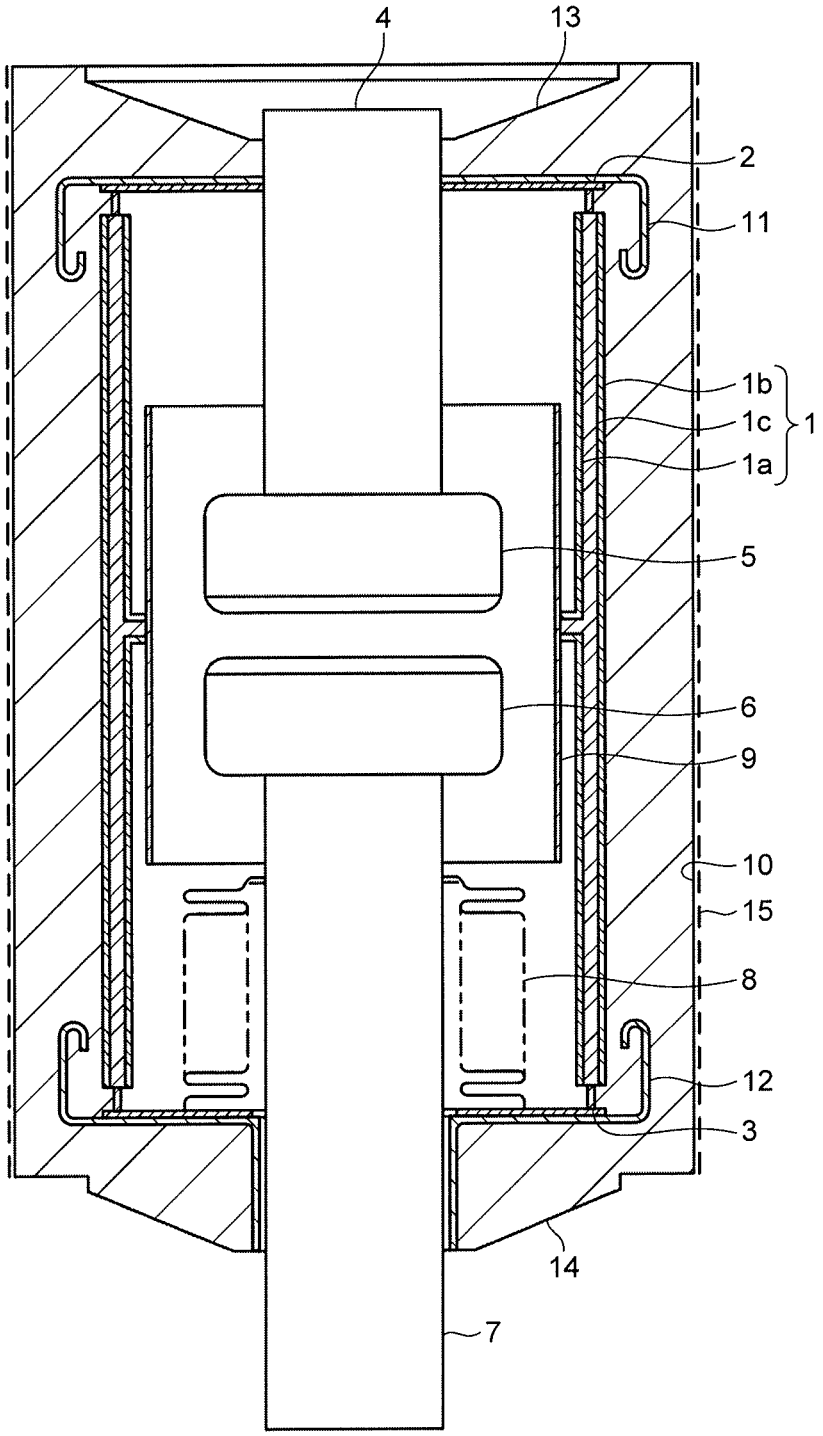
FIG. 1 is a sectional view illustrating a configuration of a vacuum valve according to a first embodiment.
Figure 2:
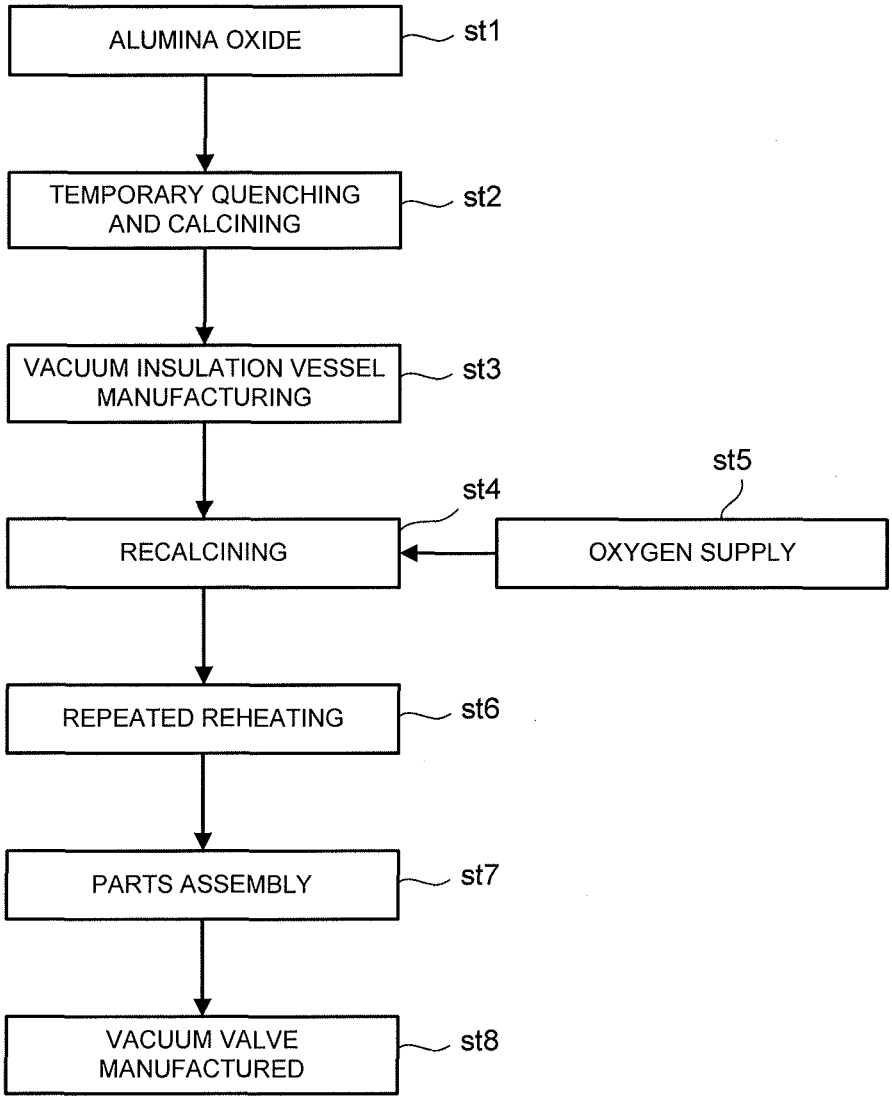
FIG. 2 is a flow chart explaining a manufacturing method for the vacuum valve according to the first embodiment.
Figure 3:
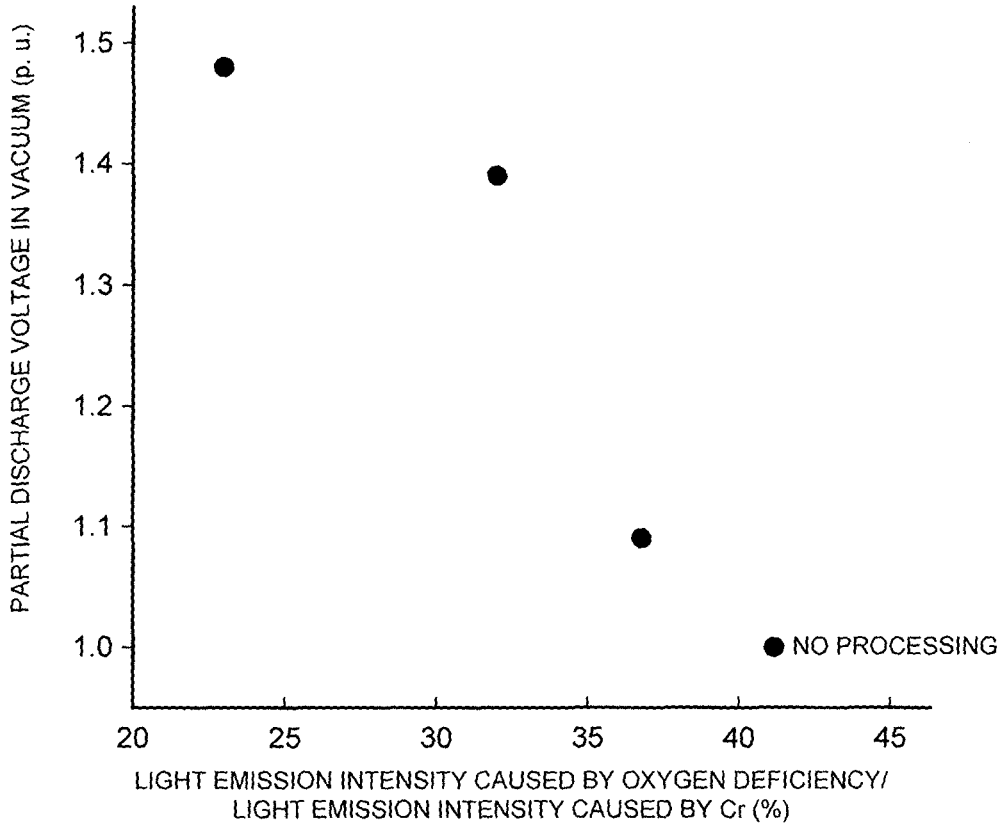
FIG. 3 is a properties figure showing a relation between luminescence intensity by electrification and partial discharge properties according to the first embodiment.
Figure 4:
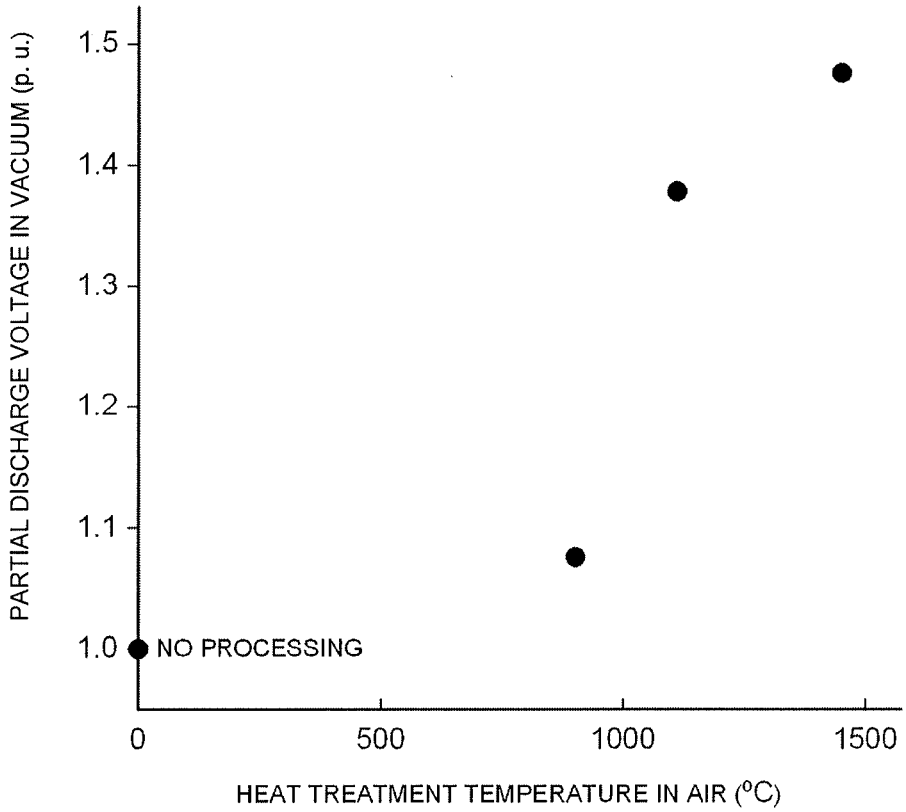
FIG. 4 is a properties figure showing a relation between a heat treatment temperature of a vacuum insulation vessel and the partial discharge properties according to the first embodiment.

First, a vacuum valve according to a first embodiment will be described with reference to FIGS. 1 to 4. FIG. 1 is a sectional view illustrating a configuration of the vacuum valve according to the first embodiment. FIG. 2 is a flow chart explaining a manufacturing method for the vacuum valve according to the first embodiment. FIG. 3 is a properties figure showing a relation between luminescence intensity by electrification and partial discharge properties according to the first embodiment. FIG. 4 is a properties figure showing a relation between heat treatment temperature of a vacuum insulation vessel and the partial discharge properties according to the first embodiment.

As shown in FIG. 1, a cylindrical vacuum insulation vessel 1 made of alumina ceramics is used for the vacuum valve.

Openings on both ends of the vacuum insulation vessel 1 are sealed with a fixed side sealing metal fitting 2 and a movable side sealing metal fitting 3 respectively. That is, the fixed side sealing metal fitting 2 and the movable side sealing metal fitting 3 seal the openings on the both ends of the vacuum insulation vessel 1 respectively. A fixed side conductor 4 passes through the fixed side sealing metal fitting 2, and is fixed to it. A fixed side contact point 5 is fixed to one end of the fixed side conductor 4 inside the vacuum insulation vessel 1.

A movable side contact point 6 is disposed to face the fixed side contact point 5, and can be in contact or out of contact with it. The movable side contact point 6 is fixed to one end of a movable side conductor 7 which passes though the opening of the movable side sealing metal fitting 3, and can move along the opening.

One end of elastic bellows 8 is fixed to the intermediate part of the movable side conductor 7, and the other end is fixed to the movable side sealing metal fitting 3.

A cylindrical arc shield 9 is disposed to surround the contact points 5, 6 and is fixed to the inside of the vacuum insulation vessel 1.

Here, the vacuum insulation vessel 1 includes a 1st oxidization promotion layer 1*a* formed on its inner circumference, a 2nd oxidization promotion layer 1*b* formed on its outer circumference, and a base material layer 1*c* of alumina oxide formed in the middle of their thickness directions. The 1st oxidization promotion layer is a layer whose oxygen combination was promoted, and the 2nd oxidization promotion layer 1*b* is similar to the 1st oxidization promotion layer. The vacuum valve includes above elements.

Next, the configuration of a molded vacuum valve will be described. An insulating layer 10 formed by insulating material such as an epoxy resin is formed in the surroundings of the vacuum insulation vessel 1.

In the insulating layer 10, a fixed side electric field relief shield 11 is embedded around the fixed side sealing metal fitting 2, and a movable side electric field relief shield 12 is embedded around the movable side sealing metal fitting 3.

A tapered shape fixed side interface 13 and a tapered shape movable side interface 14 are formed at both ends of the direction of an axis of the insulating layer 10 respectively, and connected to other electrical equipment.

Except for the fixed side and the movable side interfaces 13, 14, a grounding layer 15 to which conductive coating is applied is formed on the outer circumference of the insulating layer 10.

Next, a manufacturing method of the vacuum valve will be described with reference to FIG. 2.

As shown in FIG. 2, first, the alumina oxide fabricated by prescribed (cylindrical) shape is carried into a heating furnace as in the conventional method (st1). Then, it is quenched temporarily and calcined in the range of 1000~1400 Celsius degrees, which is a 1st temperature range (st2).

A glaze process is performed as necessary, and the vacuum insulation vessel 1 is manufactured (st3).

In this state, contact points 5, 6, etc. are assembled as a next process in the conventional method.

Although the whole of the vacuum insulation vessel 1 may be the base material layer 1*c* of the alumina oxide, oxygen defective parts whose combination with oxygen is not enough may appear.

For this reason, the vacuum insulation vessel 1 is carried into the heating furnace again, and it is re-heated for 1 to 2 hours in the temperature mentioned later and it is re-calcined (st4).

Although the atmosphere circulates in the heating furnace, heating air may be sent into there to supply oxygen (st5).

The re-heating process may be repeated two or more times (st6).

Oxygen combination progresses by such heating process, and the 1st and 2nd oxidization promotion layers 1*a*, 1*b* whose oxygen defective parts are controlled are formed on at least inner and outer circumferences of the vacuum insulation vessel 1 respectively.

The whole of the vacuum insulation vessel 1 may be the oxidization promotion layer by prolonged re-heating. As a next process, the contact points 5, 6, etc. are assembled, using such the vacuum insulation vessel 1 (st7), and the vacuum valve is manufactured (st8).

That is, a pair of contact points 5, 6 which can be brought into contact or out of contact with each other is put into the inside space of the vacuum insulation vessel 1 from its openings, which is made of the prescribed shaped (cylindrical) alumina oxide, and the 1st and 2nd oxidization promotion layers 1*a*, 1*b* are formed in. Then, the vacuum valve is manufactured by sealing the openings with sealing metal fittings such as the fixed side sealing metal fitting 2 and the movable side sealing metal fitting 3.

Next, luminescence intensity properties and partial discharge properties of the vacuum insulation vessel 1 which is re-heated, changing the temperature will be described with reference to FIG. 3 and FIG. 4.

An alumina-ceramics board which modeled the vacuum valve was used for these measurements. They were adjusted so that electric field distribution, etc. might be similar, and were carried out in the vacuum.

The data on the luminescence intensity were gathered based on Cr which were impurities and were the easiest to detect by spectrometry of cathode luminescence. The conventional product which was not re-heated is defined as "No processing".

As shown in FIG. 3 and FIG. 4, the product re-heated at 800 Celsius degrees for an hour decreased the luminescence intensity and improved the partial discharge properties compared with "No processing". When the temperature of re-heating was raised up to a 2nd temperature, for example, 1250 or 1400 Celsius degrees, which is the high temperature side of the 1st temperature range in st2, the luminescence intensity decreased further and the partial discharge properties improved further.

It is expected that although the electrification and the luminescence occur in the oxygen defective parts in the conventional product, the oxygen defective parts are restored by re-heating and the electrification becomes difficult to occur.

If the temperature of re-heating is greater than or equal to 1250 Celsius degrees, the luminescence intensity is less than or equal to 32%, the partial discharge properties improve rapidly, and the big effect is shown.

If the fresh air is sent in the heating furnace during re-heating or the re-heating is repeated 2 to 3 times, the partial discharge properties can improve further.

The vacuum insulation vessel 1 which has such the oxidization promotion layers 1*a*, 1*b* improves surface insulating properties greatly. It can be used in the vacuum valve itself and the mold vacuum valve which the insulating layer 10 is formed in.

According to the vacuum valve of the first embodiment mentioned above, when the vacuum insulation vessel 1 is manufactured, the re-heating process is carried out and the oxidization promotion layers 1*a*, 1*b* whose oxygen defective parts are restored are formed on its surfaces. Therefore, the electrification is difficult to occur and the surface insulating properties can improve.

Next, a second embodiment will be described with reference to FIG. 5.

Second Embodiment

Figure 5:
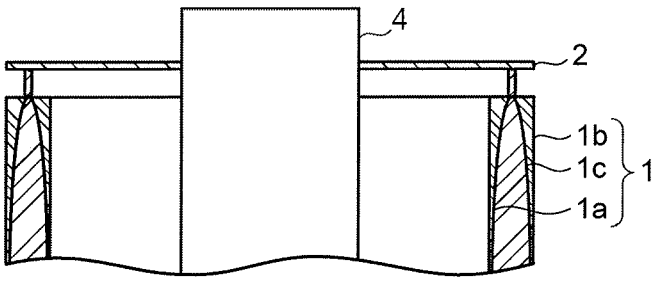
FIG. 5 is an important section enlarged sectional view illustrating a configuration of a vacuum valve according to a second embodiment.

FIG. 5 is an important section enlarged sectional view illustrating a configuration of a vacuum valve according to the second embodiment.

The second embodiment differs from the first embodiment in the shape of the oxidization promotion layers.

In FIG. 5, the same parts as those of the first embodiment will be designated by like reference symbols with no description made thereon.

As shown in FIG. 5, the 1st and 2nd oxidization promotion layers 1*a*, 1*b* are formed in the vacuum insulation vessel 1 so that the thickness of them thicken toward to the openings of the vacuum insulation vessel 1. That is, the thickness of the oxidization promotion layers 1*a*, 1*b* on the side of the openings is thicker than some on the opposite side of the openings (at the central part side).

For example, if the hot wind is directly sprayed on the openings at the time of re-heating, the 1st and 2nd oxidization promotion layer 1*a*, 1*b* whose thickness near their ends thickens can be formed as mentioned above.

According to the vacuum valve of the second embodiment as mentioned above, since the most field electrons are emitted from the fixed side (movable side) sealing metal fitting 2 (3), the electrification can make it harder to occur by thickening the thickness of the 1st and 2nd oxidization promotion layer 1*a*, 1*b* near their ends, in addition to the effects obtained in the first embodiment.

According to the embodiments which were described above, the electrification phenomenon on the surface of the vacuum insulation vessel can be suppressed, and the surface insulating properties can improve.

While certain embodiments of the present invention have been described above, these embodiments are presented by way of example and are not intended to limit the scope of the present invention. These embodiments can be modified in many different forms. Various kinds of omission, substitution and modification may be made without departing from the scope and spirit of the present invention. These embodiments and the modifications thereof fall within the scope and spirit of the present disclosure and are included in the scope of the present disclosure recited in the claims and the equivalent thereof.

EXPLANATION OF REFERENCE NUMERALS

1: vacuum insulation vessel, 1*a:* 1st oxidization promotion layer, 1*b:* 2nd oxidization promotion layer, 1*c*: base material layer, 2: fixed side sealing metal fitting, 3: movable side sealing metal fitting, 5: fixed side contact point, 6: movable side contact point, 10: insulating layer, 15: grounding layer

What is claimed is:

1. A vacuum valve, comprising:

a cylindrical shaped vacuum insulation vessel having openings on both ends;

sealing metal fittings configured to seal the openings of the vacuum insulation vessel; and a pair of contact points which can be brought into contact or out of contact with each other and arranged within the vacuum insulation vessel, wherein the vacuum insulation vessel includes:

a base material layer of aluminum oxide;

a first oxidization promotion layer whose oxygen combination was promoted, said first oxidization promotion layer formed on an inner circumference of the base material layer; and a second oxidization promotion layer whose oxygen combination was promoted, said second oxidization promotion layer formed on an outer circumference of the base material layer.

2. The vacuum valve of claim 1, wherein thickness of the first oxidization promotion layer or the second oxidization promotion layer on a side of the openings is thicker than the thickness on an opposite side of the openings.

3. The vacuum valve of claim 1, wherein an insulating layer molded by insulating material is formed in surroundings of the vacuum insulation vessel.

4. A manufacturing method for a vacuum valve, comprising:

a calcining step of calcining aluminum oxide fabricated by cylindrical shape having openings on both ends and heating the aluminum oxide in a first temperature range;

a re-heating step of re-heating the calcined aluminum oxide at a second temperature which is on high temperature side of the first temperature range, forming a first oxidization promotion layer whose oxygen combination was promoted, said first oxidization promotion layer formed on an inner circumference of the aluminum oxide, and forming a second oxidization promotion layer whose oxygen combination was promoted, said second oxidization promotion layer formed on an outer circumference of the aluminum oxide;

a disposing step of disposing a pair of contact points which can be brought into contact or out of contact with each other inside of the aluminum oxide from openings; and a sealing step of sealing the openings by sealing metal fittings.

5. The manufacturing method for the vacuum valve of claim 4, wherein the re-heating step is repeated.

6. The manufacturing method for the vacuum valve of claim 4, wherein the second temperature is greater than or equal to 1250 Celsius degrees.

* * * * *